US007922055B2

(12) United States Patent
Nayrac et al.

(10) Patent No.: US 7,922,055 B2
(45) Date of Patent: Apr. 12, 2011

(54) HOUSING FOR AN ENERGY SOURCE IN A HAND-OPERATED DEVICE HAVING A MECHANISM FOR EJECTING THE SOURCE

(75) Inventors: Frederic Nayrac, Bourg les Valence (FR); Patrick Herelier, Saint Jean de Muzols (FR); Cyril Marion, Valence (FR); Roland Almeras, Tournon (FR)

(73) Assignee: Societe De Prospection ET D'Inventions Techniques Spit, Bourg-Les-Valence (FR)

( * ) Notice: Subject to any disclaimer, the term of this patent is extended or adjusted under 35 U.S.C. 154(b) by 161 days.

(21) Appl. No.: 11/910,024

(22) PCT Filed: Apr. 25, 2006

(86) PCT No.: PCT/IB2006/001015

§ 371 (c)(1),
(2), (4) Date: Sep. 28, 2007

(87) PCT Pub. No.: WO2006/114695

PCT Pub. Date: Nov. 2, 2006

(65) Prior Publication Data

US 2008/0190985 A1 Aug. 14, 2008

(30) Foreign Application Priority Data

Apr. 26, 2005 (FR) ..... 05 04155

(51) Int. Cl.
*B25C 1/08* (2006.01)

(52) U.S. Cl. ..... 227/10; 227/9; 137/322

(58) Field of Classification Search ..... 227/10
See application file for complete search history.

(56) References Cited

U.S. PATENT DOCUMENTS

| | | | | |
|---|---|---|---|---|
| 925,959 | A * | 6/1909 | Smith | 285/280 |
| 3,216,140 | A | 11/1965 | Termet | |
| 3,292,668 | A * | 12/1966 | Little | 141/330 |
| 3,400,704 | A * | 9/1968 | Schlamp et al. | 126/38 |
| 3,608,538 | A * | 9/1971 | Guerrero | 126/266 |
| 3,883,062 | A | 5/1975 | Jochum et al. | |
| 3,884,256 | A * | 5/1975 | Corlet | 137/322 |

(Continued)

FOREIGN PATENT DOCUMENTS

EP 1310334 A 5/2003

OTHER PUBLICATIONS

International Search Report for PCT/IB2006/001015 mailed Oct. 6, 2006.

*Primary Examiner* — Rinaldi I. Rada
*Assistant Examiner* — Lindsay Low
(74) *Attorney, Agent, or Firm* — Lowe Hauptman Ham & Berner LLP

(57) ABSTRACT

The housing is intended to receive a source introduced by means of its head and pushed into a position ensuring good transmission of energy. The housing includes a mechanism for converting a transverse movement towards the interior of the housing imparted by a pusher element of the mechanism accessible from the exterior of the housing into an orthogonal movement for ejection of the source.

10 Claims, 5 Drawing Sheets

U.S. PATENT DOCUMENTS 4,342,725 A * 8/1982 Collins ..... 422/126
4,436,125 A * 3/1984 Blenkush ..... 141/330
4,613,112 A * 9/1986 Phlipot et al. ..... 251/149.6
4,693,242 A * 9/1987 Biard ..... 128/204.26
4,717,060 A 1/1988 Cotta et al.
4,739,915 A 4/1988 Cotta et al.
5,035,345 A * 7/1991 Janko et al. ..... 222/5
5,090,747 A * 2/1992 Kotake ..... 285/305
5,104,158 A * 4/1992 Meyer et al. ..... 285/308
5,213,913 A * 5/1993 Anthony et al. ..... 429/97
5,225,293 A * 7/1993 Mitchell et al. ..... 429/97
5,494,074 A * 2/1996 Ramacier et al. ..... 137/614.04
5,589,288 A * 12/1996 Coulson et al. ..... 429/96
5,637,417 A * 6/1997 Engmark et al. ..... 429/97
5,842,682 A * 12/1998 Schennum et al. ..... 251/149.1
5,984,266 A * 11/1999 Kotake ..... 251/149.1
6,071,639 A * 6/2000 Bryant et al. ..... 429/97
6,168,881 B1 * 1/2001 Fischer et al. ..... 429/97
6,996,987 B2 * 2/2006 Gregory et al. ..... 60/632
7,429,430 B2 * 9/2008 Mooty et al. ..... 429/100

* cited by examiner

HOUSING FOR AN ENERGY SOURCE IN A HAND-OPERATED DEVICE HAVING A MECHANISM FOR EJECTING THE SOURCE

RELATED APPLICATIONS

The present application is based on International Application No. PCT/IB2006/001015 filed Apr. 25, 2006, and claims priority from French Application Number 0504155 filed Apr. 26, 2005, the disclosure of which is hereby incorporated by reference herein in its entirety.

FIELD OF THE INVENTION

The invention relates to gas fastening devices drawing their combustion and drive energy for a piston for driving a fastening element from a gas cartridge connected to a transmission element for filling the combustion chambers of these devices, this element generally being formed by a solenoid valve.

BACKGROUND OF THE INVENTION

Possible gas fastening devices are, e.g. nail drivers, hammers and other staplers.

These devices include a housing for receiving a cartridge held in this housing by means integral with the devices, such as, e.g. a flap, a cap or a fork slid into a channel in the outlet fitting of the cartridge.

During operation, the cartridge and the solenoid valve are connected together in a sealed manner by means of a connecting adapter integral with the cartridge and hooked on to an intermediate inlet fitting integral with the solenoid valve.

SUMMARY OF THE INVENTION

The invention relates firstly to a housing for a gas cartridge in a gas fastening device, the housing being intended to receive a cartridge introduced by means of its head and pushed into a position in which the head of the cartridge is hooked on to a gas transmission element of the fastening device, the housing being characterised in that it includes a mechanism for converting a transverse movement towards the interior of the housing imparted by a pusher element of the mechanism accessible from the exterior of the housing into an orthogonal movement for ejection of the cartridge.

The ejection mechanism preferably includes a collar designed to be driven in the direction of ejection by the pusher of the transmission element and unhook the head of the cartridge.

The pusher and the ejection collar are also preferably designed to cooperate by a wedge effect.

In the preferred embodiment of the invention, the pusher includes a ring intended to be passed around the cartridge and the ejection collar, also intended to be passed around the cartridge, includes an internal annular rim for driving the cartridge.

It has already been stated hereinabove that the invention arose from a problem encountered with gas fastening devices. However, the Applicant does not intend to limit the scope of his application solely to the use of gas cartridges in fastening devices.

A gas cartridge is an energy source for a gas combustion device in which sealing must be ensured between the cartridge and the gas transmission element. The invention of this application in fact applies equally to any other energy source for a hand-operated device, such as electric fastening devices operating with the aid of a battery which must also be removable from its housing without too much difficulty.

The invention therefore relates more generally to a housing for an energy source in a hand-operated ice, the housing being intended to receive a source introduced by means of its head and pushed into a position ensuring good transmission of energy, the housing being characterised in that it includes a mechanism for converting a transverse movement towards the interior of the housing imparted by a pusher element of the mechanism accessible from the exterior of the housing into an orthogonal movement for ejection of the source.

BRIEF DESCRIPTION OF THE DRAWING

The invention will be more readily understood with the aid of the following description of the preferred embodiment of the housing for a cartridge of the invention, with reference to the accompanying drawings, in which.

Figure 1:
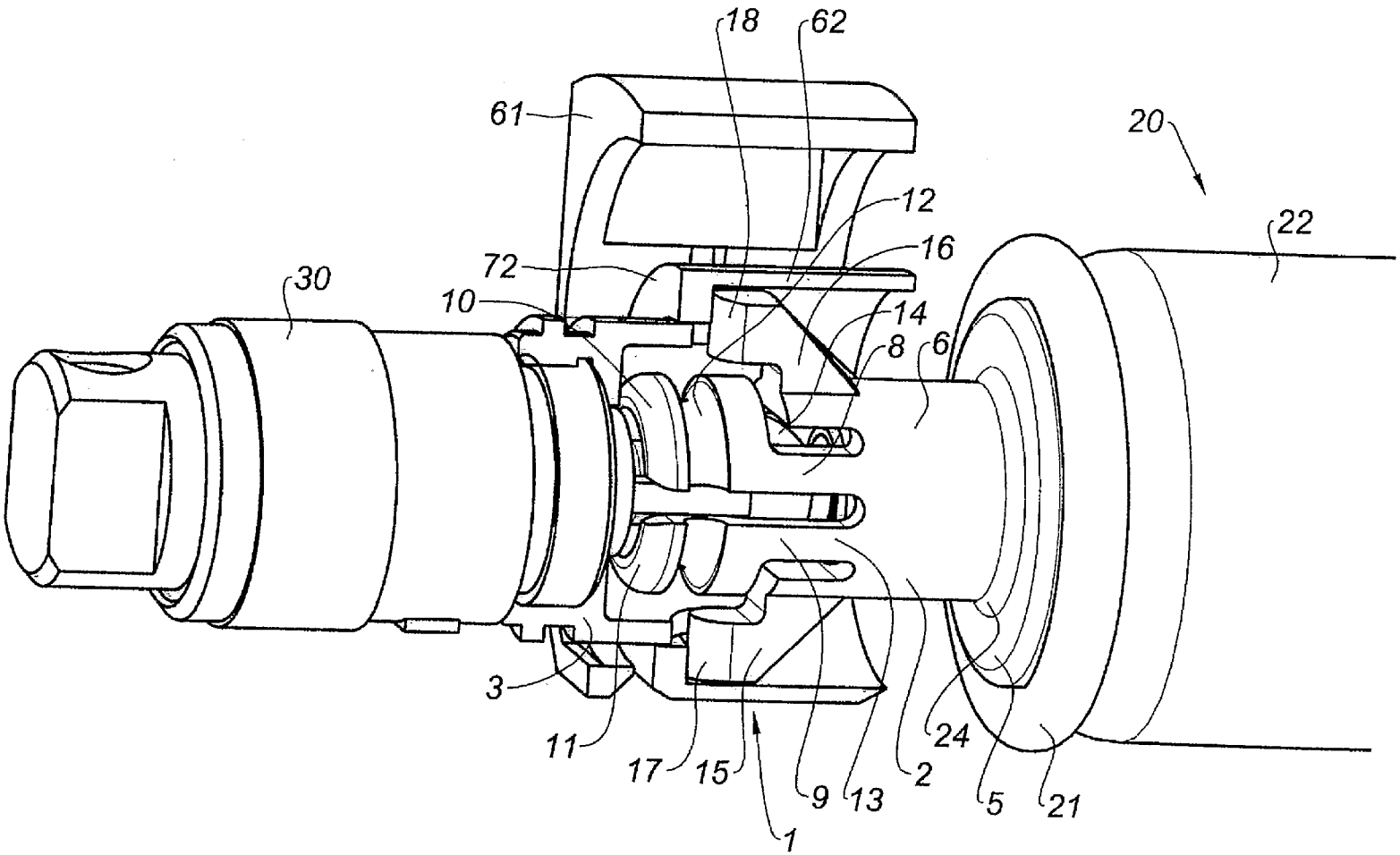
FIG. 1 is a cut-away perspective view of a cartridge with its adapter and the ejection mechanism for the cartridge, prior to ejection.
Figure 2:
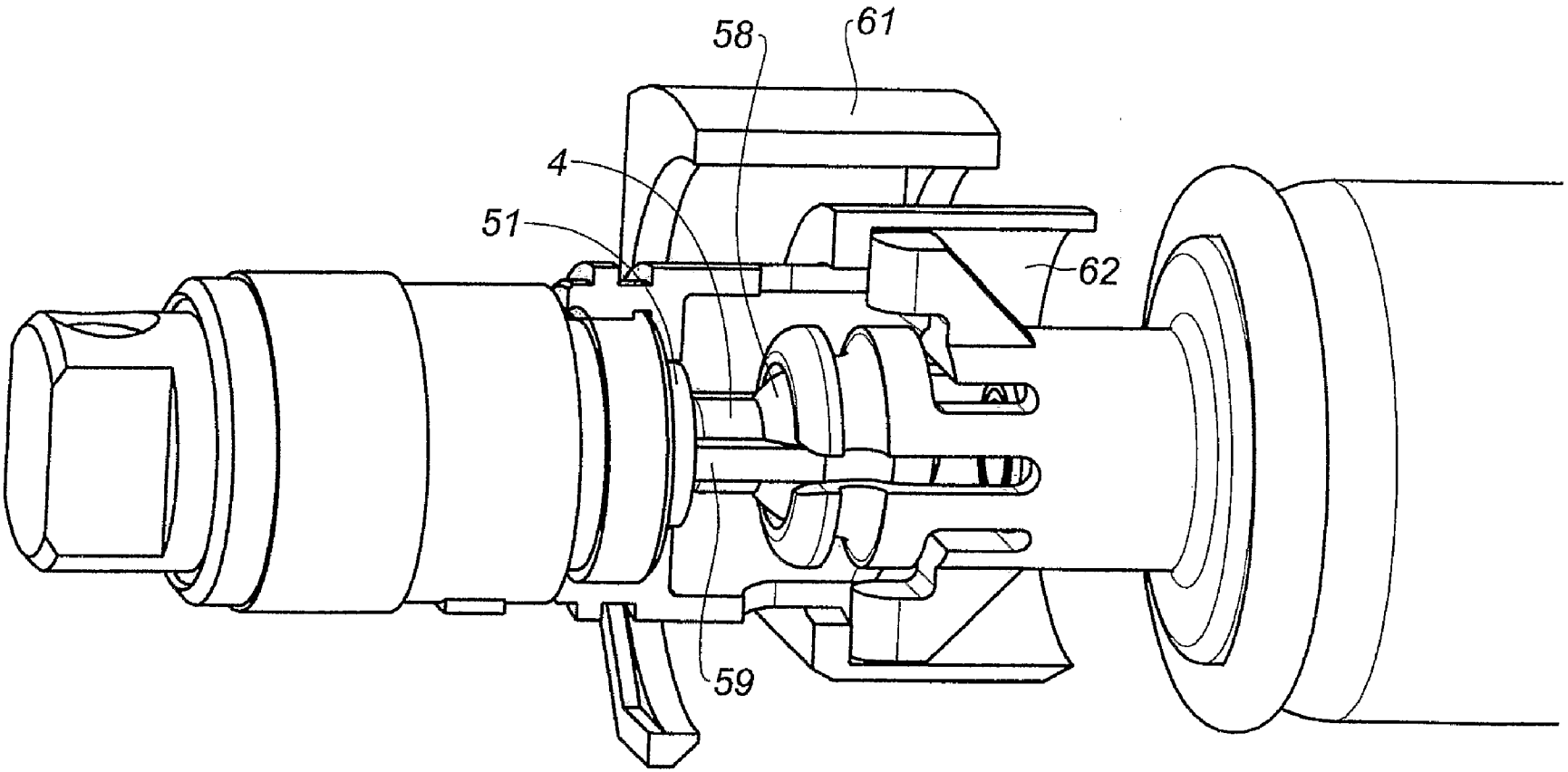
FIG. 2 is an analogous view to that of FIG. 1, but after the operation of the ejection mechanism.
Figure 3:
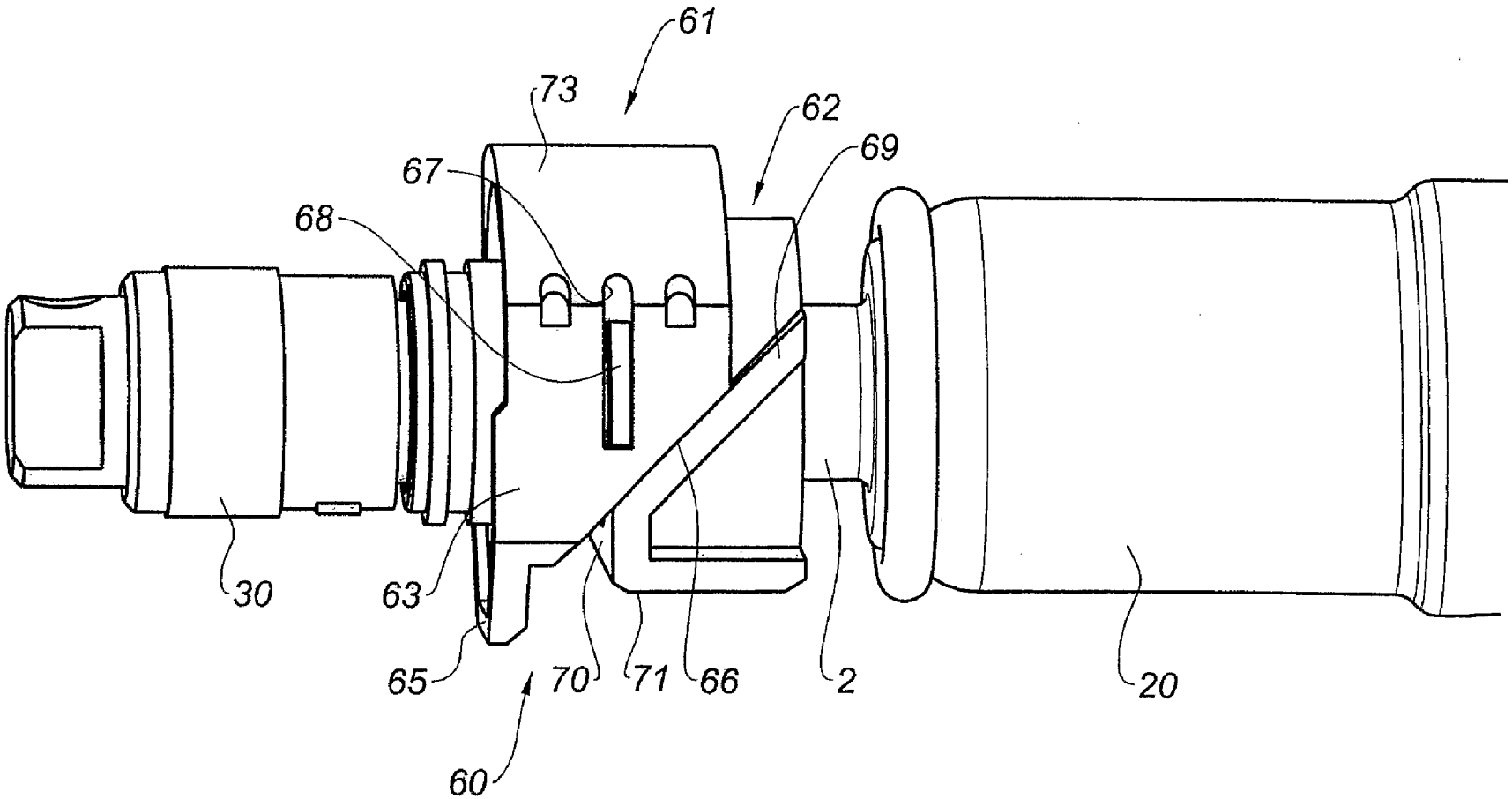
FIG. 3 is a lateral view of the cartridge and its adapter and of the ejection mechanism.
Figure 4:
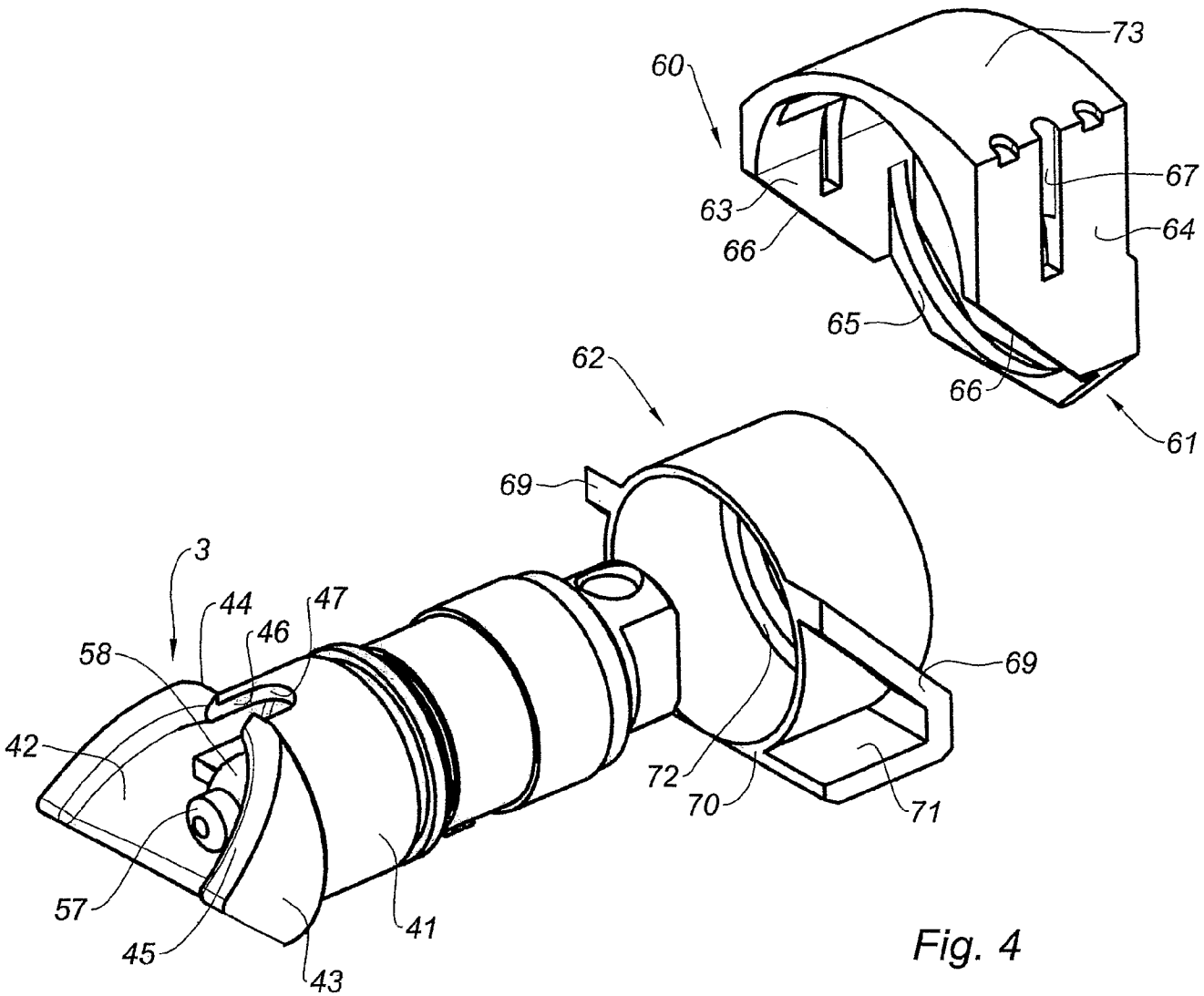
FIG. 4 is an exploded view of the ejection mechanism as the solenoid valve is being mounted in the housing.

The elements which will now be described are intended to
i) connect a propellant cartridge 20 and a solenoid valve 30 for filling the combustion chamber of a hand-operated gas device, in this case a fastening device, by mutual hooking and locking in rotation and
ii) unhook the cartridge from the solenoid valve in order to eject it from its housing.

DETAILED DESCRIPTION OF THE DRAWING

A fastening device for fastening fastening elements by means of a piston driven by compressed gas comprises an internal combustion engine comprising a combustion chamber intended to be supplied with compressed gas from a gas cartridge 20 in order to drive the piston itself intended to drive the fastening elements.

In this particular example, connecting members 1 intended to connect the solenoid valve 30 and the compressed gas cartridge 20 are provided.

The cartridge 20 of generally cylindrical shape is provided in an internal casing with the compressed gas in the liquid state and between the internal casing and an external casing 22 with a propellant. A circular edge 21 forms a continuation of the external cylindrical wall of the cartridge 20, at one of the ends of the latter. A male outlet fitting connected to the internal casing projects from the cartridge by means of a base 24 situated in the centre of the dish formed in the interior of the edge 21.

The solenoid valve 30 of generally cylindrical shape is provided at one of its ends with an inlet fitting connected in the interior of the solenoid valve to an outlet fitting (not shown). The inlet fitting is in this case a male fitting.

The connecting members 1 comprise

- an adapter 2, in this case mounted on the cartridge 20, for hooking, angular indexing and locking in rotation;
- a skin 3, in this case mounted on the solenoid valve 30, for angular indexing and locking in rotation:

an intermediate fitting 4 mounted on the solenoid valve 30, and a sealing connector mounted in the adapter 2.

Adapter

The adapter 2 serves as a support for the sealing connector, serves for the mutual hooking of the cartridge 20 and the solenoid valve 30 and serves for the angular indexing and locking in rotation of the cartridge and the solenoid valve in cooperation with the skirt 3 of the solenoid valve 30.

The adapter 2 includes a flat, in this case, circular supporting base 5 to which fastening legs extending into the internal dish of the edge perpendicularly to the base and spread apart in order to engage with the internal wall of the edge 21 are connected.

On the other side of the fastening legs, the supporting base 5 is extended by a tubular chamber 6 having a considerably smaller section than the base 5. This chamber is slotted in an axial plane in order to give two slightly hinged hooking legs 8, 9 substantially halfway along the chamber. The free ends 10, 11 of the hooking legs are designed as semi-circular beads each forming an internal circular hooking shoulder for a spherical element of the intermediate fitting of the solenoid valve. A peripheral groove 12 for receiving a torus (not shown) for pressing the legs together is formed on the exterior of the free ends 10, 11 of the hooking legs 8, 9. So that they can be hinged, the hooking legs are partially hollowed out so that they are generally in the form of an inverted U hinged about the ends 13 of the two parallel legs of the U.

Ribs or fins 15, 16 project radially towards the exterior in the same axial plane from the internal portions of the hollowed-out windows 14 in the two hooking legs 8, 9 in order to provide transverse end bosses 17, 18 projecting slightly from the chamber 6, extending substantially in the transverse plane of the groove 12 and intended to be received in the bottoms of lateral channels in the indexing and locking skirt 3. These end bosses, as described in more detail hereinafter, will play a role in the ejection of the cartridge from its housing.

Indexing and Locking Skirt

This is a generally tubular element provided on one side with an end 41 for fastening to the solenoid valve and on the other side with indexing flanges 42, 43" formed in a tubular portion which is thicker than the fastening portion, has the same internal wall and therefore forms an annular external shoulder 44. In general, these indexing flanges 42, 43 have been obtained by the intersection of the said thick tubular portion by a tubular element having an axis orthogonal to the axis of the skirt, giving edges 45 acting as angular indexing ramps. Each indexing flange has two ramp portions 45 inclined in opposite directions with top rounding between them and extending substantially over 180°. Two lateral anti-rotation channels 46 each extending in the same axial plane to a bottom 47 in the thin tubular fastening portion 41 have been cut out in the axial plane separating the two flanges 42, 43.

Intermediate Fitting

This is a tubular spacer 4 provided at one end with a sleeve portion 51 for covering the fitting of the solenoid valve. The intermediate spacer 4 is provided at the other end with a small tubular end portion 57 intended to be introduced into the sealing connector. A spherical hooking portion 58 connected to the sleeve portion 51 by the spacer 4 and two positioning ribs 59 is situated adjacent to the end portion 57.

The spacer 4 is traversed from one end to the other by a duct for the passage of gas.

Sealing Connector

This is a seal having a generally tubular shape.

The unhooking and ejection mechanism 60 is mounted on the housing 80 for the cartridge 20 and the solenoid valve 30. It is an elongated housing having a length substantially equal to the sum of the lengths of the cartridge 20, its adapter 2 and the solenoid valve 30. The housing 80 having a generally parallelepipedal shape includes a cradle-shaped bottom 81 for receiving the cartridge, the bottom being provided with an opening 82 for the passage of a pusher 61 intended to unhook the adapter 2 of the cartridge from the intermediate fitting 4 of the solenoid valve by means of an ejection collar 62.

The pusher 61 includes a cylindrical skirt portion 73 extended by two flat lateral blank portions 63, 64 joined together by a ring portion 65. The pusher extends axially over a small length from the plane of the ring 65. The cylindrical skirt portion 73 is designed to plug the opening 82 provided in the bottom 81 of the housing.

The plane of the ring portion 65 completes the cylinder of the skirt portion 73 in order to receive the adapter 2 of the cartridge 20.

The lateral blanks 63, 64 have a generally trapezoidal shape, each having a ridge 66 inclined towards the rear and towards the exterior and serving as a ramp element for the wedge effect with the ejection collar. A groove 67 is formed in each of the blanks in order to receive a corresponding rib 68 projecting from the internal wall of the cradle-of the housing and to thereby guide the sliding of the pusher 61 when it is operated.

The ejection collar 62 is a tubular element to which two ribs 69 inclined towards the rear and towards the exterior and intended to cooperate with the ridges 66 of the pusher 61 in order to cause a wedge effect are added laterally and on the exterior, but in this case in an integrally moulded manner. The ribs 69 are joined together by a transverse flat portion 70 and a plate 71 substantially tangential to the tubular portion of the collar. The flat connecting portion 70 is extended in its plane by an internal annular rim 72 for pushing and driving the cartridge.

The pusher 61 and the collar 62 form a mechanism for converting a transverse movement towards the interior of the bottom of the housing (when the pusher 61 is pushed so that it is displaced transversely to the axis) into an orthogonal ejection movement, in this case in a direction parallel to the axis by virtue of the wedge effect exerted by the ramps 66 of the pusher 61 and the ribs 69 of the collar 62.

The pusher 61 and the collar 62 are free in their housing in the transverse direction. Irrespective of the position of this assembly, the introduction of the cartridge acts by means of the bosses 17, 18 on the rim 72 of the collar 62, which drives the pusher 61 by the wedge effect and repositions the assembly 61, 62.

Figure 5:
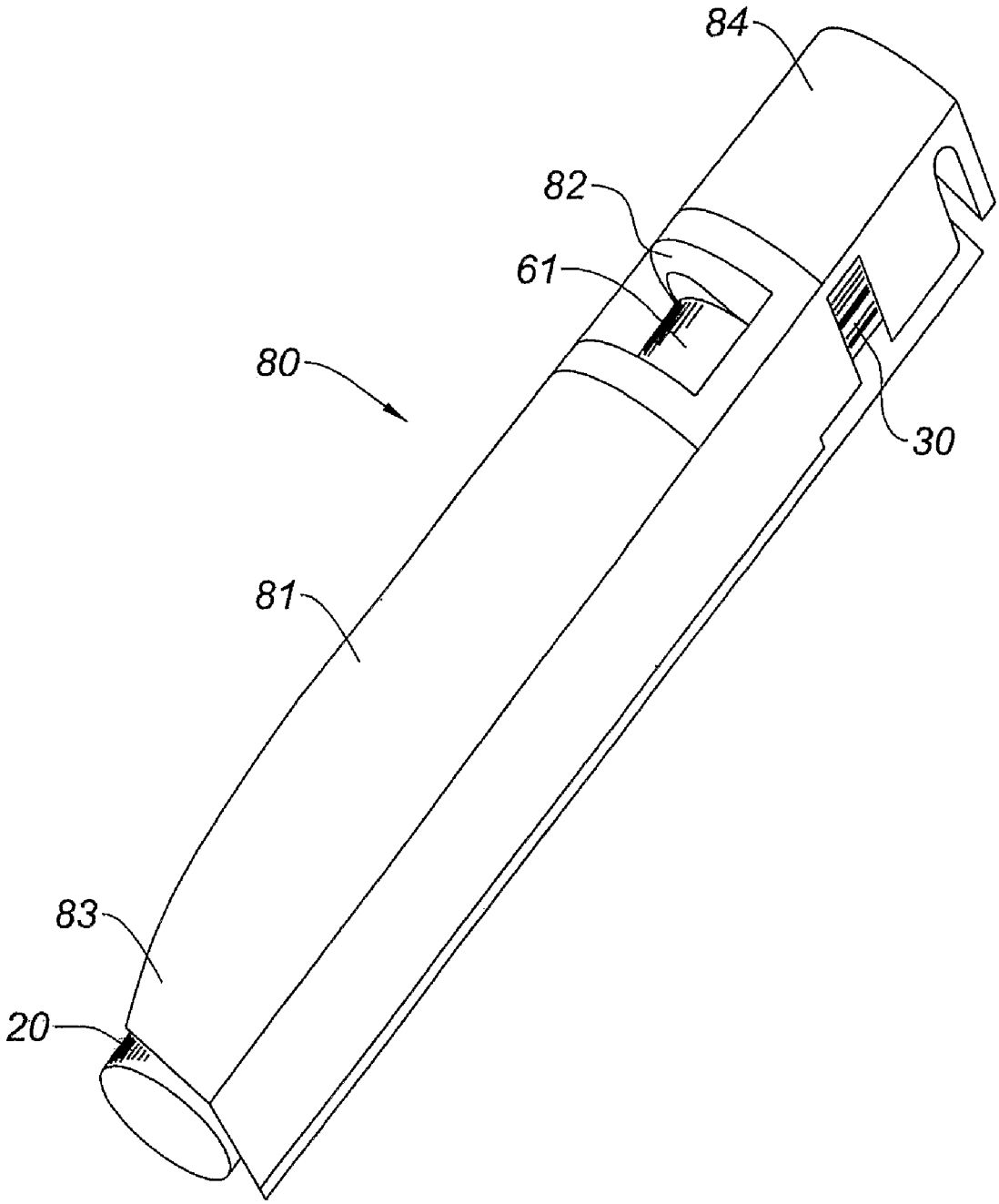
FIG. 5 is a perspective view of the housing with the cartridge and the solenoid valve.

In FIG. 5, the pusher 61 is in the retracted position, the cartridge 20 not yet itself being in the connecting position.

The connection of the solenoid valve 30 and the cartridge 20 will now be described. Once the intermediate fitting 4 has been introduced by means of its sleeve 51 into the solenoid valve 30, it is covered by the skirt 3 by fastening the skirt 3 to the solenoid valve by means of the end 41, in this case by screwing the, in this case, tapped end 41 of the skirt 3 on to the threaded edge of the solenoid valve.

The solenoid valve 30 is then placed in the housing 80 together with its indexing and locking skirt 3 by introducing them from the rear 83 towards the front 84 through the ejection collar 62 and the ejection pusher 61, the solenoid valve then resting on circular transverse supporting ribs.

Once the adapter 2 has been generally mounted on the cartridge 20 after the cartridge has been introduced into its housing in the device, it is pushed towards the solenoid valve. If the angular position of the cartridge is not correct, the fins 15, 16 of the adapter 2 come to a stop against the edges 45 of the skirt by means of their end bosses 17, 18.

By virtue of their inclination, as they continue to push the cartridge towards the solenoid valve, the fins 15, 16 will slide on to the edges 45, thereby rotating the cartridge as a result of the ramp effect, i.e. until these fins engage in the lateral channels 46 in the skirt 3. As soon as the fins 15, 16 begin to engage in the channels 46 in the skirt 3, with the cartridge then being locked in rotation, the hooking legs 8, 9 of the adapter 2 come into contact with the spherical portion 58 of the intermediate fitting 4, which spreads them apart until, as a result of the action of the return torus (not shown), when the spherical portion is situated at the hollowed-out windows 14, when legs 8, 9 are pressed together again over this spherical portion 58 in order to ensure that the adapter 2 of the cartridge 20 is hooked on to the intermediate fitting 4 of the solenoid valve 30, i.e. the cartridge 20 and the solenoid valve 30 are connected together. The fins 15, 16 then bear b> means of their end bosses 17, 18 against the annular rim 72 of the ejection collar 62, itself bearing against the ring 65 of the pusher 61.

The unhooking of the cartridge 20 from the solenoid valve 30 will now be described. When the operator presses on the pusher 61, he drives it in transverse displacement which, by virtue of its ramps 66 and the ribs 69 of the collar 62 and therefore by a wedge effect, is converted into axial displacement which drives the ejection collar 62 towards the exterior.

By means of its annular rim 72, the collar 62 drives the fins 15, 16 of the adapter 2 by means of their bosses 17, 18, and therefore drives the cartridge 20 towards the exterior in order to eject it from its housing.

The invention claimed is:

1. A housing for an energy source for a hand-operated device, comprising:

a fitting element which is detachably connectable with a head of the energy source for transmission of energy from the energy source to the device;

a pusher element which is accessible from an exterior of the housing and is moveable in a first direction; and an ejecting element directly engaged with said pusher element and engageable with the energy source, an entirety of said ejecting element being driven by a movement of said pusher element in the first direction to move in a second direction, which is transverse to the first direction, for forcing the energy source to move in the second direction away from said fitting element and for causing the head of the energy source to be disconnected from said fitting element;

wherein said ejecting element comprises an annular collar extending outside and around said fitting element and being adapted to extend outside and around the energy source and to directly engage the energy source for driving the energy source in the second direction away from said fitting element in response to the movement of said pusher element in the first direction;

said housing further comprising an annular skirt which extends outside and around said fitting element, wherein said collar extends outside and around said annular skirt; and said annular skirt comprises a locking element for locking the energy source against rotation about an axis oriented in the second direction when the head of the energy source is connected to said fitting element.

2. The housing of claim 1, wherein said annular skirt further comprises a ramp for guiding the energy source being pushed toward said fitting element to rotate about said axis until the energy source is locked against rotation by said locking element.

3. The housing of claim 2, wherein said locking element comprises a channel at an end of said ramp and being elongated in the second direction for allowing the energy source, after being locked against rotation in said channel, to linearly move in the second direction toward said fitting element until said fitting element is connected with the head of the energy source.

4. A housing for a gas fastening device, said housing comprising:

a fitting element which is detachably connectable with a head of a gas cartridge for supplying gas to said device;

a pusher element which is accessible from an exterior of the housing and is moveable in a direction transverse to an axial direction of said housing; and an ejecting mechanism engageable with both said pusher element and the gas cartridge; wherein said ejecting mechanism is moveable in the axial direction in response to a movement of said pusher element in the transverse direction for ejecting the gas cartridge in the axial direction away from said fitting element and causing the head of the gas cartridge to be disconnected from said fitting element;

wherein said ejecting mechanism is moveable in the axial direction in response to the movement of said pusher element in the transverse direction even when the gas cartridge is not in the housing;

one of said ejection mechanism and said pusher element has a surface slanted with respect to both the transverse and axial directions; and the other of said ejection mechanism and said pusher element is in direct contact with and slidable on said surface in the movement of said pusher element in the transverse direction to cause an entirety of said ejection mechanism to move in the axial direction.

5. The housing of claim 4, wherein said ejecting mechanism is directly engaged with said pusher element, and is driven to move in the axial direction away from said fitting element by the movement of said pusher element in the transverse direction.

6. A housing for a gas fastening device, said housing comprising:

a fitting element which is detachably connectable with a head of a gas cartridge for supplying gas to said device;

a pusher element which is accessible from an exterior of the housing and is moveable in a direction transverse to an axial direction of said housing; and an ejecting mechanism engageable with both said pusher element and the gas cartridge; wherein said ejecting mechanism is moveable in the axial direction in response to a movement of said pusher element in the transverse direction for ejecting the gas cartridge in the axial direction away from said fitting element and causing the head of the gas cartridge to be disconnected from said fitting element;

wherein said ejecting mechanism is moveable in the axial direction in response to the movement of said pusher element in the transverse direction even when the gas cartridge is not in the housing;

said housing further comprising a locking element for locking the gas cartridge against rotation about an axis oriented in the axial direction when the head of the gas cartridge is connected to said fitting element; and a ramp for guiding the gas cartridge being pushed toward said fitting element to rotate about said axis until the gas cartridge is locked against rotation by said locking element;

wherein said locking element comprises a channel at an end of said ramp and being elongated in the axial direction for allowing the gas cartridge, after being locked against rotation in said channel, to linearly move in the axial direction toward said fitting element until said fitting element is connected with the head of the gas cartridge.

7. In combination, a housing for a gas fastening device and a gas cartridge received in said housing for supplying gas to said device;

wherein said housing comprises:

a fitting element detachably connected with a head of the gas cartridge for gas transmission to said device;

a pusher element which is accessible from an exterior of the housing and is moveable in a direction transverse to an axial direction of said housing; and an ejecting mechanism directly engaged with both said pusher element and the gas cartridge for directly converting a transverse movement of said pusher element in the transverse direction into an axial movement of said gas cartridge in the axial direction away from said fitting element, said axial movement being sufficient to cause the head of said gas cartridge to be disconnected from said fitting element;

wherein said ejecting mechanism moves in the axial direction along with said gas cartridge in response to the transverse movement of said pusher element in the transverse direction;

one of said ejection mechanism and said pusher element has a surface slanted with respect to both the transverse and axial directions; and the other of said ejection mechanism and said pusher element is slidable on said surface in the transverse movement of said pusher element to cause said axial movement of both said ejecting mechanism and said gas cartridge.

8. The combination of claim 7, wherein said housing further comprises:

a channel elongated in the axial direction for locking said gas cartridge against rotation about an axis oriented in the axial direction when the head of said gas cartridge is being pushed toward said fitting element, and for subsequently allowing said gas cartridge, after being locked against rotation in said channel, to linearly move in the axial direction toward said fitting element until said fitting element is connected with the head of the gas cartridge.

9. In combination, a housing for a gas fastening device and a gas cartridge received in said housing for supplying gas to said device;

wherein said housing comprises:

a fitting element detachably connected with a head of the gas cartridge for gas transmission to said device;

a pusher element which is accessible from an exterior of the housing and is moveable in a direction transverse to an axial direction of said housing; and an ejecting mechanism directly engaged with both said pusher element and the gas cartridge for directly converting a transverse movement of said pusher element in the transverse direction into an axial movement of said gas cartridge in the axial direction away from said fitting element, said axial movement being sufficient to cause the head of said gas cartridge to be disconnected from said fitting element;

wherein an entirety of said pusher element is moveable in the transverse direction and inwardly of the housing; and an entirety of said ejecting mechanism is driven, by the movement of the entirety of said pusher element in the transverse direction and inwardly of the housing, to move in the axial direction away from said fitting element.

10. A housing for an energy source for a hand-operated device, comprising:

a fitting element which is detachably connectable with a head of the energy source for transmission of energy from the energy source to the device;

a pusher element which is accessible from an exterior of the housing and is moveable in a first direction; and an ejecting element directly engaged with said pusher element and engageable with the energy source, an entirety of said ejecting element being driven by a movement of said pusher element in the first direction to move in a second direction, which is transverse to the first direction, for forcing the energy source to move in the second direction away from said fitting element and for causing the head of the energy source to be disconnected from said fitting element;

wherein the entirety of said ejecting element is driven, exclusively by the movement of said pusher element in the first direction and without any spring action, to move in the second direction.

* * * * *